United States Patent [19]

Bisbing

[11] Patent Number: 4,878,367

[45] Date of Patent: Nov. 7, 1989

[54] BINARY CODED KEY AND LATCH-ACTUATOR

[75] Inventor: Robert H. Bisbing, Springfield, Pa.

[73] Assignee: Southco, Inc., Concordville, Pa.

[21] Appl. No.: 715,077

[22] Filed: Mar. 22, 1985

[51] Int. Cl.[4] ..... E05B 27/08

[52] U.S. Cl. ..... 70/491; 70/404; 70/409

[58] Field of Search ..... 70/404, 363, 345, 346, 70/347, 409

[56] References Cited

U.S. PATENT DOCUMENTS

| | | | |
|---|---|---|---|
| 2,823,725 | 2/1958 | Trince | 70/404 |
| 3,519,979 | 7/1970 | Bodenstein | 70/404 |
| 3,553,988 | 1/1971 | Fitzgerald | 70/404 |
| 3,661,001 | 5/1972 | Glass | 70/363 |

*Primary Examiner*—Robert L. Wolfe

*Attorney, Agent, or Firm*—Paul & Paul

[57] ABSTRACT

A tubular key and mating latch-actuator are provided in which the key has inner circumferential recesses and the latch-actuator has a stud having projections therefrom, the recesses and stud projections being arranged according to a binary-code so that each key of a series is unique.

5 Claims, 2 Drawing Sheets

BINARY CODED KEY AND LATCH-ACTUATOR

BACKGROUND OF THE INVENTION

This invention relates to keys and to key operated latch-actuators.

The invention relates in particular to keys having a tubular stem and to latch-actuators having a cylindrical stud for receiving the tubular key.

The keys and latch-actuators of the invention are adapted to be made in a wide variety of binary-coded forms so that a particular latch will be openable only by a key having a binary-coded configuration corresponding to that of the latch-actuator.

DETAILED DESCRIPTION OF THE PREFERRED EMBODIMENTS

The present invention is directed to a binary-coded tubular key adapted to be inserted into an annular socket to actuate a latch-actuator. The key and latch-actuator have broad application and may be used in a wide variety of latches.

Figure 1:
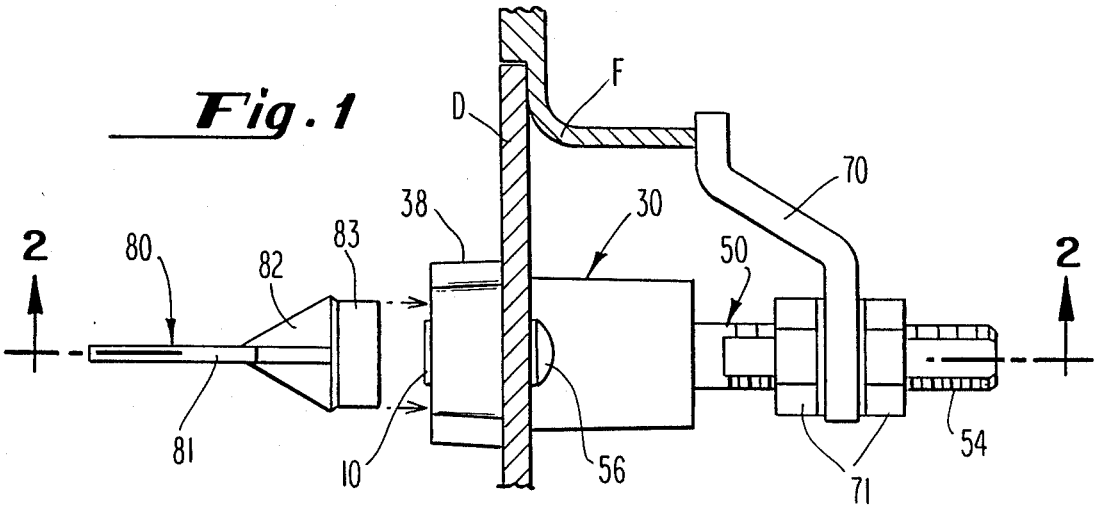
FIG. 1 is a side elevational view of a key and latch mechanism, showing the key and latch-actuator used on one of a variety of latches which are adapted to be equipped with the new key and latch-actuator.
Figure 2:
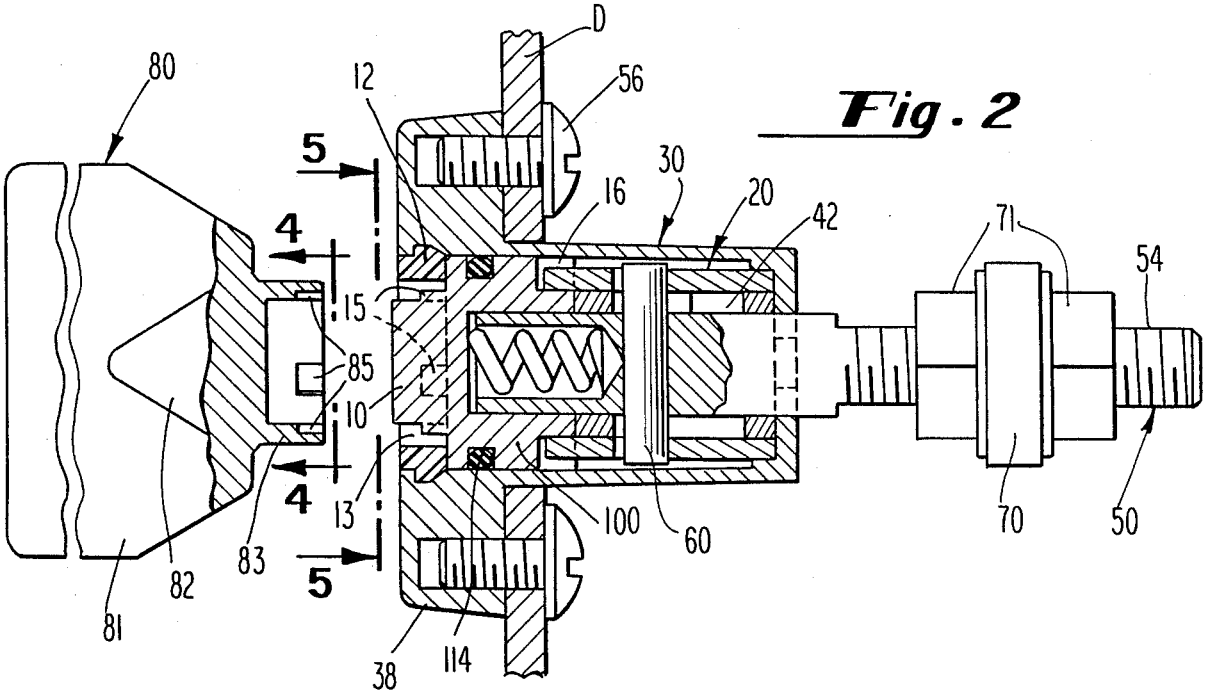
FIG 2 is a view, partly in section, looking along the line 2—2 of FIG. 1.

Illustrated in FIGS. 1 and 2 is one form of latch to which the new binary-coded key and latch-adapter may be applied. The particular latch shown in FIGS. 1 and 2 corresponds to a latch shown, described and claimed in my copending application entitled Latch Assembly Having Pull-Up Action, Serial No. 610,961, filed 05/16/84, assigned to the assignee of the present application.

In FIGS. 1 and 2, a closure element or door D has mounted thereon a latch mechanism having a housing having a barrel portion 30, a shaft 50 having a threaded end 54 and a latching pawl 70 which is mounted on the threaded end of the shaft 50 as by nuts 71, for adjustment in the axial direction of the shaft.

The latch pawl 70 is movable rotationally by shaft 50 and is also movable by shaft 50 in the longitudinal direction of the shaft. To latch the door D to the frame F, the latch pawl 70 is first rotated to a position such that it is in line with frame member F. The latch pawl 70 is then moved longitudinally so that it engages the edge of the frame member F.

The shaft 50 is moved rotationally and also longitudinally by means of a rotatable actuator 100. It is not necessary to describe in the present application the manner in which shaft 50 is moved both rotationally and longitudinally by means of the rotatable actuator 100 since this is fully described in my copending patent application Serial No. 610,961, previously referred to, and since the present application is not directed to the particular latch shown in FIGS. 1 and 2. It will merely be pointed out that the following reference numerals which appear in FIGS. 1 and 2 identify the following parts: 38 is the forward portion of the latch housing; 30 is the barrel portion; 20 is an annular cam; 42 is an annular sleeve; 60 is a cross pin; 56 are screws holding the latch housing to the door D; 114 is an O-ring; 14 is a groove for the O-ring; 16 are notches or slots in the rotatable actuator 100 for receiving ears of the cam 20.

As already indicated, the present invention is directed to a binary-coded key and latch-actuator and these will now be described in detail.

The key 80 has a flat handle portion 81 and a short tubular stem 83. A conical portion 82 provides reinforcement between the flat handle 81 and the tubular stem portion 83.

Figure 4:
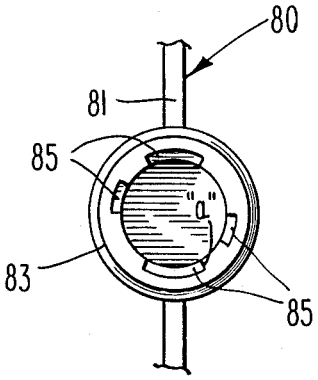
FIG. 4 is a view looking at the key along the line 4—4 of FIG. 2.
Figure 5:
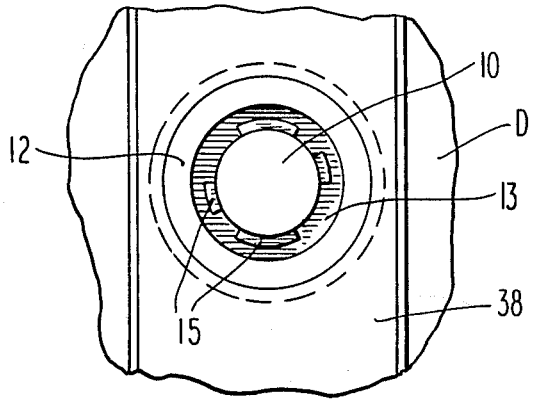
FIG. 5 is a view looking at the latch-actuator along the line 5—5 of FIG. 2.

Stem portion 83 has a bore having an internal circumferential surface having at selected locations recesses 85 of preselected circumferential width. The recesses 85 are clearly seen in FIG. 4.

In accordance with the present invention, the positions and circumferential width of the recesses 85 vary from key to key according to a binary code. Thus, each key is different from each other key.

It has been found convenient to express the key combination as a binary number in which a single notch or recess counts as a "zero" and an intervening single unnotched area counts as a "one". For example, in the particular key illustrated in FIG. 4, the internal circumference of the bore of the tubular key is assumed to be divided into twelve equal divisions. Assume that the count starts at point "a" in FIG. 4, and that the count is made in a clockwise direction. The key combination of the key in FIG. 4 may then be expressed as follows: 001101001101. That is to say, the key of FIG. 4, starting at point "a" and counting in the clockwise direction, has two recesses, two nonrecesses, one recess, one nonrecess, two recesses, two nonrecesses, one recess and one nonrecess.

It has been determined that if the internal bore of a key is divided circumferentially into twelve equal parts, the number of unique combinations of recesses and nonrecesses is eighty.

If, instead of twelve, the internal bore of the key is divided circumferentially into sixteen equal parts, the number of unique combinations is 810.

In FIG. 2, the tubular binary-coded stem 83 of key 80 is insertable into an annular cavity 13, and in so doing mates with the key-receiving stud portion 10 of the rotatable actuator 100.

Figure 3:
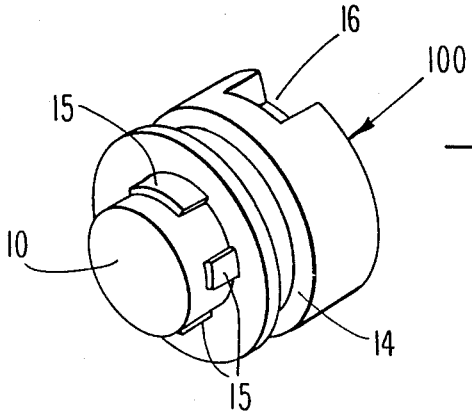
FIG 3 is a perspective view of the latch-actuator.

The rotatable actuator 100 is shown in perspective in FIG. 3. As there seen, the stud portion 10 is provided with projections 15 which are of a size and so positioned as to correspond with the recesses 85 of the key 80 so as to allow the stud 10 to enter into the bore of the key 80.

Figure 6:
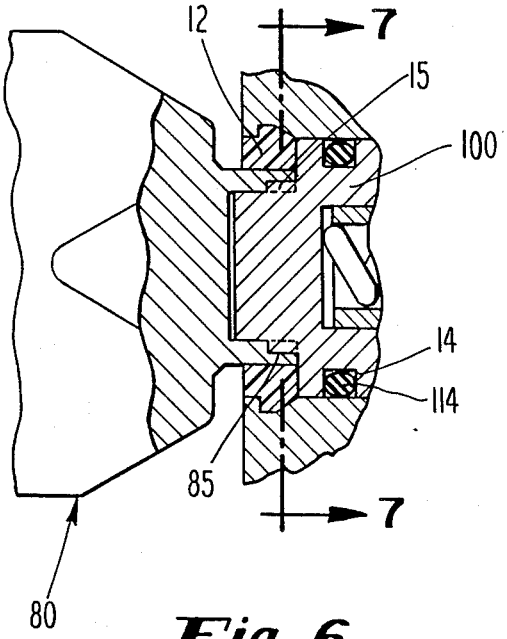
FIG. 6 is a fragmentary view similar to a portion of FIG. 2 but showing the key inserted into the socket and in engagement with the latch-actuator.
Figure 7:
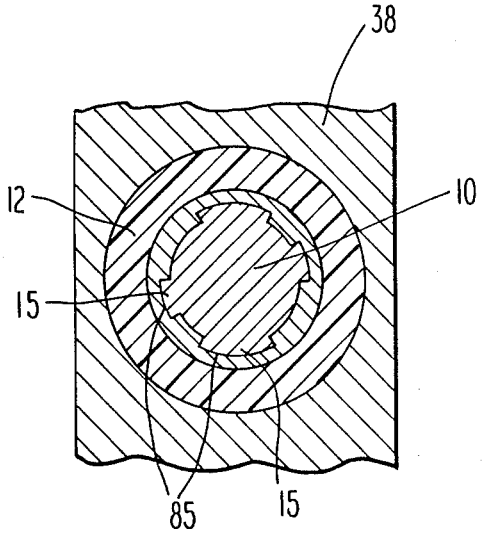
FIG. 7 is a view looking along the line 7—7 of FIG. 6.

FIG. 6 is an illustration showing the tubular stem portion 83 of key 80 inserted into the annular cavity 13 in mating engagement with the binary-coded stud portion 10 of the rotatable actuator 100.

In FIG. 6, when the tubular binary-coded stem portion 83 of key 80 is inserted into the annular cavity 13, the outer circumferential surface of the stem 83 comes into sliding engagement with the wall of a tubular retainer 12. Retainer 12 is not connected to the rotatable actuator 100 and is preferably but not necessarily nonrotatable in the body portion 38 of the housing of the latch. If retainer 12 does move rotatably, its rotation is independent of that of the latch-actuator 100. This arrangement makes it impossible, or at least very difficult, to rotate the latch-actuator by means of a tool other than the tubular key which mates with the latch-actuator.

I claim:

1. In combination a binary-coded key and mating latch actuator comprising:

(a) a key having a tubular stem forming an internal bore, said stem having radial recesses in its inner circumferential wall of a preselected number and at preselected locations;

(b) a rotatable latch actuator having a stud portion having radial projections therefrom the size and location of said projections corresponding to the recesses in the inner wall of said stem to permit said stud portion to be received within the bore of said tubular stem of said key;

(c) wherein the surface of the inner circumferential wall of said tubular key is considered to be divided circumferentially into a predetermined number of equal divisions, each division corresponding to a "0" or a "1" in the binary code according to whether said division is recessed or non-recessed; and (d) wherein the number and locations of the recesses in the key stem are fixed in accordance with said binary code.

2. The combination according to claim 1 wherein said latch-actuator is mounted in a latch having a fixed body portion having an outer surface located in substantially the same plane as the outer end of said stud portion, and an annular socket surrounding said stud portion for receiving the tubular stem of said key.

3. The combination according to claim 2 wherein said annular socket has an outer wall which is disconnected from said rotatable stud portion of said latch-actuator.

4. The combination according to claim 1 wherein the number of recesses is equal to the number of non-recesses.

5. A key and latch-actuator system comprising a plurality of pairs of mated keys and latch-actuators, each pair different from the others, in which:

(a) each key has a tubular stem forming an internal bore having radial recesses in its internal wall;

(b) each latch-actuator has a stud portion having radial projections therefrom corresponding to the recesses in each mated key;

(c) the recesses in each key are spaced circumferentially in accordance with a preselected binary code based upon a division of the inner circumferential wall of the tubular key into a predetermined number of equal divisions corresponding to zero or one, dependent upon whether the division is recessed or non-recessed, with the binary code for each mated pair being different from the binary codes for the other mated pairs.

* * * * *